US010479569B2

(12) United States Patent
Carlson et al.

(10) Patent No.: US 10,479,569 B2
(45) Date of Patent: Nov. 19, 2019

(54) SEALABLE CONTAINERS

(71) Applicant: The Decor Corporation Pty. Ltd., Scoresby (AU)

(72) Inventors: Arthur Richard Carlson, Hawthorn East (AU); Jim Samartgis, Eltham (AU)

( * ) Notice: Subject to any disclaimer, the term of this patent is extended or adjusted under 35 U.S.C. 154(b) by 0 days.

(21) Appl. No.: 14/429,698

(22) PCT Filed: Sep. 20, 2013

(86) PCT No.: PCT/AU2013/001075

§ 371 (c)(1),
(2) Date: Mar. 19, 2015

(87) PCT Pub. No.: WO2014/056016

PCT Pub. Date: Apr. 17, 2014

(65) Prior Publication Data

US 2015/0232242 A1 Aug. 20, 2015

(30) Foreign Application Priority Data

Sep. 21, 2012 (AU) ..... 2012904142
Jul. 11, 2013 (AU) ..... 2013902551

(51) Int. Cl.
*B65D 51/24* (2006.01)
*B65D 53/02* (2006.01)
(Continued)

(52) U.S. Cl.
CPC ..... *B65D 51/245* (2013.01); *B65D 13/02* (2013.01); *B65D 43/02* (2013.01); *B65D 47/32* (2013.01);
(Continued)

(58) Field of Classification Search
CPC ..... B65D 15/245; B65D 13/02; B65D 43/02; B65D 47/32; B65D 53/06; B65D 2101/0084
(Continued)

(56) References Cited

U.S. PATENT DOCUMENTS 4,836,397 A 6/1989 Fowles
5,799,792 A 9/1998 Abrums
(Continued)

FOREIGN PATENT DOCUMENTS

EP 1516956 A1 3/2005
EP 1516957 A1 3/2005
(Continued)

OTHER PUBLICATIONS

"Citizenpip Airtight Food Container", Sep. 10, 2010.*
(Continued)

*Primary Examiner* — James N Smalley
*Assistant Examiner* — Madison L Poos
(74) *Attorney, Agent, or Firm* — Cook Alex Ltd.; R. Blake Johnston

(57) ABSTRACT

A container for storage is provided which includes, as principle components, a base member (1) and a lid (100) therefor, with the lid (100) in use overlaying said base member (1) in a sealing relationship, with both the base member (1) and lid (100) having associated therewith a strip or base (5.104) of a color different to the remainder of the base member (1) and lid (100) respectively, the strip or band (5) of the base member (1) being of the same color as the strip of band (104) of the lid (100), thereby to allow for ready matching of the lid (100) with container base (1).

12 Claims, 19 Drawing Sheets

(51) Int. Cl.

| | |
|---|---|
| ***B65D 13/02*** | (2006.01) |
| ***B65D 43/02*** | (2006.01) |
| ***B65D 47/32*** | (2006.01) |
| ***B65D 53/06*** | (2006.01) |

(52) U.S. Cl.
CPC ..... *B65D 53/02* (2013.01); *B65D 53/06* (2013.01); *B65D 2203/12* (2013.01); *B65D 2543/0024* (2013.01); *B65D 2543/00027* (2013.01); *B65D 2543/0099* (2013.01); *B65D 2543/00101* (2013.01); *B65D 2543/00296* (2013.01); *B65D 2543/00305* (2013.01); *B65D 2543/00481* (2013.01); *B65D 2543/00537* (2013.01); *B65D 2543/00555* (2013.01); *B65D 2543/00564* (2013.01); *B65D 2543/00842* (2013.01); *B65D 2543/00972* (2013.01)

(58) Field of Classification Search
USPC ..... 220/367.1; 40/310, 311, 312, 313; 215/230
See application file for complete search history.

(56) References Cited

U.S. PATENT DOCUMENTS

| | | | | |
|---|---|---|---|---|
| 5,813,553 | A | 9/1998 | Herr et al. | |
| 5,829,611 | A | 11/1998 | Beck | |
| 6,494,464 | B1 * | 12/2002 | Chandler | B65D 53/06 220/377 |
| 6,745,505 | B2 * | 6/2004 | Moran | G09F 3/00 215/230 |
| 8,596,492 | B2 * | 12/2013 | Lown | B65D 43/0212 220/787 |
| 9,108,766 | B2 * | 8/2015 | Gosen | B65D 21/0223 |
| 2003/0116572 | A1 * | 6/2003 | Klock | A47J 36/027 220/367.1 |
| 2005/0006390 | A1 * | 1/2005 | Wang | B65D 45/30 220/326 |
| 2007/0131701 | A1 * | 6/2007 | Herbert | B65D 21/0233 220/826 |
| 2008/0087624 | A1 * | 4/2008 | Buckley | A47G 23/16 215/230 |
| 2009/0090721 | A1 | 4/2009 | Buisson | |
| 2010/0072099 | A1 * | 3/2010 | Klein | B65D 51/20 206/459.5 |
| 2010/0147846 | A1 * | 6/2010 | Soibel | B65D 43/0212 220/202 |
| 2011/0155607 | A1 * | 6/2011 | Tetreault | A47J 36/06 206/459.5 |
| 2011/0315702 | A1 | 12/2011 | LeBoeuf et al. | |
| 2013/0075295 | A1 * | 3/2013 | Sina | B65D 43/0208 206/459.5 |

FOREIGN PATENT DOCUMENTS

| | | | |
|---|---|---|---|
| GB | 436989 | A | 10/1935 |
| GB | 1213150 | | 11/1970 |
| WO | WO 1985/000344 | A1 | 1/1985 |
| WO | WO 1999/028205 | A1 | 6/1999 |
| WO | WO 03/053789 | | 7/2003 |
| WO | WO 2008/100271 | A1 | 8/2008 |
| WO | WO 2010/121295 | | 10/2010 |
| WO | WO 2011/151630 | | 12/2011 |

OTHER PUBLICATIONS

Extended European Search Report dated Mar. 24, 2016, for European Patent Application No. 13844947 (International Application No. PCT/AU2013/001075).
International Search Report dated Jan. 24, 2014, for International Application No. PCT/AU2013/001075 filed Sep. 20, 2013.
Examination Search Report from The Caraadian Intellectual Property Office, dated May 1, 2018 for Application No. 2,885,608 , PCT AU13001075.

* cited by examiner

SEALABLE CONTAINERS

This application is a U.S. National Stage of PCT International Patent Application No. PCT/AU2013/001075, filed Sep. 20, 2013, which claims the benefit of and priority to Australian Application No. 2012904142, filed Sep. 21, 2012 and Australian Application No. 2013902551, filed Jul. 11, 2013, which are hereby incorporated by reference in their entirety.

FIELD OF THE INVENTION

The present invention relates, in general terms, to improvements in sealable containers. More particularly, but not exclusively, the invention relates, to improvements in sealable food storage containers for household/domestic use. It should be understood, however, that containers in accordance with the present invention are suited for use in any context, for storage of foodstuffs and/or other products and articles, and are not to be considered to be in any way limited to usage only in a household or domestic situation or environment.

The invention relates, in one particular embodiment, to improvements in the sealable container which is the subject of the present applicant's International Patent Application No. PCT/AU2010/000439

BACKGROUND OF THE INVENTION

Household storage containers—especially for the storage of food— are widely known and have enjoyed extensive usage for a significant period of time. Typically such containers may be formed from a suitable resilient plastics material. However, in more recent times containers of this general type are also being manufactured from alternative mouldable materials such as for example glass. In that regard, therefore, it should be understood that whilst throughout the ensuing specification reference will be made to particular and preferred embodiments of sealable containers in accordance with the invention made principally if not exclusively of a suitable plastics material, the invention is under no circumstances to be considered to be limited to containers of such material. Indeed containers in accordance with the present invention could equally be constructed principally from glass.

Containers of this general type may be employed, in the household or domestic environment, for purposes of storage of a variety of different products, and more especially foodstuffs of the perishable type. Such containers can also be employed to house or contain such perishable foodstuffs for purposes of cooking or heating thereof, more particularly in a microwave oven. In that regard it should be understood that containers of a plastics material are, generally speaking at least, not considered suitable for use in a conventional oven or the like heating means. That said, these days plastics materials do exist that are heat-resistant to a significant degree, such as to allow containers of this general type to be made therefrom which can be utilised in a conventional-type oven. As such, the containers the subject of the present invention, are not to be considered to be constructed solely from glass.

Containers of this type generally consist of at least two principal components, namely a container base, and a lid or top which matches with and is compatible with the container base, whereby to allow for sealing of the overall container combination and protection from deterioration of any content thereof. In an alternative embodiment the container will include a base, a co-operating lid and a further separate sealing means.

In an especially preferred embodiment the invention relates to an improved food storage container of the type including a base, a co-operating lid and a further separate sealing means to be associated therewith, to provide sealing of the lid to the base of the overall container. Containers of this general type, by reason of the improved sealing effect attributable thereto and exhibited thereby, are, desired to be suitable for use regardless of temperature, whether freezing/cool or elevated/high temperatures. However, care needs to be exercised to ensure that such containers are not subjected to any temperature sufficiently elevated to give rise to deterioration and/or loss of structured integrity, as for example by melting or softening.

Prior art containers of this general type have been found, in practice, to suffer from a number of practical disadvantages. By way of example only, in the domestic situation (or for that matter in any context of use) there have been found to exist problems in terms of being able to readily "marry up" a container base (of any given or desired size and shape) with the correct compatible container lid (of the same size and shape). This has been found to be especially the case when container bases and lids of this general type are stored in kitchen drawers or the like. In any normal domestic situation the householder will have available for use and will have acquired any number of such container bases and associated lids, of various shapes and sizes. These would conventionally be stored in one kitchen drawer or the equivalent, but in some situations where space is available the container bases might be stored in one drawer, with the container lids being stored in a separate drawer. No matter how stored, however, the householder can be expected to always encounter problems/difficulties/frustrations in choosing the desired sized and shaped container base to suit particular use requirements and then locating the compatible lid. In that regard it should be understood that conventional practice is not to store containers of this general type with the base and lid connected, since such has been found to sometimes give rise to an undesirable odour, as well as the possibility of unwanted condensation within the closed overall container, giving rise to the need for cleaning thereof before use.

Problems have also been found to exist, insofar as the manufacturers and marketers of such containers are concerned, in terms of displaying such products for sale. In that regard it should be understood that prospective purchasers need to be able to see/identify the size and shape of the container base and matching lid, and to choose the product to suit that person's particular needs or usages. Since the overall size for such a container can vary markedly dependent upon its intended use, then in terms of display for sale purposes each manufacturer needs to have on display numerous differently sized and shaped containers—making up its range of available products. The normal practice when displaying products of this type for sale is to display them within a given area, referred to in the commercial field as "real estate". For display purposes such real estate is costly. The usual practice is for the marketer, whether a department store, supermarket, mega store or the like, to allow each manufacturer or "brand" a certain space in terms of real estate. It becomes imperative for the manufacturer, therefore, especially when such manufacturer is unable to secure from the commercial outlet more real estate, to maximise the usage of the available area provided for purposes of display of its various products.

A further practical disadvantage associated with storage of containers of this general type with base and lid joined together or attached is that such a combination requires more space for storage and precludes altogether the possibility of or potential for stacking, whether of a plurality of lids and/or a plurality of containers. Whether in the domestic or commercial environment it is extremely desirable to maximise usage of available storage space. Any arrangement which allows for more containers to be stored, for display or whatever, in a given space is desirable.

In real terms the same situation applies in the domestic situation or environment. Storing matching lids and container bases together, in their in-use condition, means fewer can be located in a given space, as for example a storage drawer, cupboard or the like. Furthermore, if so stored there again exists the problem of unwanted condensation within the sealed container.

As in the domestic situation, in the marketplace it is again not the general practice to display containers of this type with the container base and container lid interconnected or in the in-use condition. Indeed such display would, if anything, minimise usage of the available real estate. An aim, therefore, has been to manufacture and market containers of this type which are stackable. However more often than not, or conventionally, container bases currently available do not stack tightly, therefore again not allowing for maximization of usage of available real estate.

For purposes of display or sale, therefore, prior art containers of this general type need to be displayed with the container base (of each size and shape) in close proximity to the matching or compatible lid. It would be preferred, however, if one could readily match up a lid with its associated container base, no matter how they be disposed spatially one relative to the other.

Containers of this general type in one especially preferred embodiment typically include a base which is adapted, in use, to retain or have located therein a quantity of food or any material for storage, a lid which in use co-operates with the base whereby to close or seal the overall container, and a separate further sealing means which, in use, co-operates with both the base and the lid.

It must be understood that the degree or effectiveness of sealing provided between the base and the lid of such a container is of great significance. A stronger seal, for example, can be expected to minimise, if not prevent altogether, the possibility of contamination and/or deterioration of the contents of the container, and hence increase the storage life of such contents. Further an appropriate seal, together with a resilient lid and associated base, will also function to expel a quantity of air from the container base during the procedure of sealing of the overall container, creating a reduced pressure within the container itself, thereby even further improving the overall efficiency of operation/sealing. Indeed the existence of such a reduced pressure within the container can also result in a significantly improved storage life for the contents thereof. The more airtight is a container base and lid combination, then the longer the possible storage life for contents thereof.

Prior art arrangements have generally utilised interlocking ribs and grooves to afford sealing or a sealing effect. Such arrangements have been found, in practice, to be sometimes difficult to open and/or close. In an attempt to overcome such a problem, containers have been utilised wherein the lid is retained in place relative to the associated base merely due to the reduced pressure existing within the overall container, once the lid is in place. With such a prior art container a one-way valve or the equivalent in the lid allows air to escape when manual pressure is applied to deform the lid—made of a suitably resilient material—inwardly. This creates or gives rise to a reduced pressure (when compared with atmosphere or ambient pressure) within the container, serving to retain the lid in position relative to the base, at least to an extent.

However, arrangements such as those referred to above have been found, in practice, to not maintain for any significant period of time any reduced pressure initially achieved within a sealed container. As a consequence, with such prior art containers the improved sealing effect evidenced by the existence of a reduced pressure within the container can be lost over a relatively short period of time, with the pressure within the container with time substantially becoming equalised with that existing externally of the container. The result is that, with such arrangements, the lid may simply be disposed over the base of the container without there being any true and proper seal therebetween. Such seriously reduces the storage life of any food contents of such a container.

Another reason for containers of this general type conventionally not being stored with bases and lids connected is that, if they were to be so stored, usage of available space will not be maximized. If a base has its lid located thereon, for example, that would rule out the possibility of stacking a number of bases together. Such is an important consideration regardless of whether storage is for retail purposes or in the domestic situation. In both cases storage space is valuable and needs to be utilized to its fullest.

The present invention seeks to overcome the problems and disadvantages associated with the prior art by providing a container, a combination of base and lid, both of which include or have associated therewith means which allow for ready identification/association of the appropriate matching base and lid. In an especially preferred embodiment such will be in the form of a colour-coded band, of any given colour, to be associated with each of the container base and the compatible container lid. Preferably the colour-coded band will be co-moulded with its associated base and lid.

The present invention also seeks to provide an improved container wherein multiple container bases of the same size and shape are adapted to stack tightly together, whereby to allow for the maximum number of similar sized and shaped containers to be displayed within a given area, whether that area be in the domestic storage situation or in real estate available to the manufacturer in a retail outlet. Different sized and different shaped container bases and associated compatible lids will have differently coloured bands. If one therefore wants to match or "marry up" a lid with its compatible container base, one merely has to identify a lid and/or a container base with the same coloured band thereon. Such is a significant improvement over the known art, regardless of context of use, whether for display purposes and/or in use.

The present invention further seeks to overcome the problems and disadvantages associated with the prior art by providing a storage container which exhibits a strong seal and associated sealing effect and further allows for maintenance of a reduced pressure within a closed sealed container. The arrangement in accordance with the present invention also acts to in effect mechanically retain the lid in position regardless of temperature. The arrangement in accordance with the present invention further allows for ready application and removal of a sealing lid.

It is an object of the invention to provide a sealable container, whether constructed wholly or in part from a plastics material or of any other suitable material, as for example glass, which functions to maintain a reduced pressure within the overall container, whereby to provide an enhanced sealing effect and improved storage life for the contents of any such container.

It is also an object of the invention to provide a container, a combination of base, lid, and separate sealing means, which includes or has associated therewith means which allow for ready identification/association of the appropriate matching base, lid and sealing means.

It is a further object of the invention to provide a sealable container which is suitable for use in any form of known heating means, including a micro-wave oven.

It is yet another object of the present invention to provide, in one preferred embodiment, a container base and a lid therefor which lend themselves to stacking, thereby maximizing usage of available storage space.

In accordance with one aspect of the present invention, therefore, there is provided a container assembly including: a container base, and a container lid which is adapted, in use, to co-operate with said container base in a sealing relationship, said container base and container lid being of a substantially complementary shape and configuration, said container base including a shaped peripheral rim, said container lid having a peripheral rim of a substantially complementary shape to the rim of said container base, said container lid being adapted in use to overlay or be disposed over said container base in said sealing relationship, and wherein both said container base and said container lid include a peripheral band, of a colour different to the colour of the container base and container lid respectively.

In accordance with a further aspect of the invention there is provided a storage container including: a base member including a bottom wall and at least one sidewall extending substantially upwardly therefrom and terminating in a peripheral rim; a lid adapted to be associated with and co-operate with said base member and to extend thereacross in a covering relationship; and sealing means adapted, in use, to be interposed between and co-operate with both said at least one sidewall of said base member and said lid, whereby to provide improved sealing for said container, wherein said sealing means is of a colour which is different to the colour of the container base member and lid respectively, and wherein said base member further includes, on the at least one sidewall thereof, an area formed integrally therewith, or associated therewith, which is of the same colour as said sealing means.

It should be understood that, in real terms, a storage container in accordance with the invention includes the following as principal components, namely:

(i) a base member which is adapted, in use, to afford space for receiving and storing any given products, as for example foodstuffs or the like;

(ii) a lid which, in use, overlays the base member; and preferably (iii) a seal which co-operates with the base member and lid to provide an enhanced sealing effect.

The base member may be constructed from either glass or a suitable plastics material and, if of a plastics material, will remain substantially rigid. The lid may be constructed/formed from a suitable plastics material or glass and, like the base member, is intended to remain in a substantially rigid condition in use. The seal, however, will preferably be constructed from a less rigid elastomeric material, as for example silicone or silicone rubber.

DESCRIPTION OF THE DRAWINGS

In order that the invention may be more clearly understood and put into practical effect there shall now be described in detail preferred constructions of an improved container in accordance with the invention. The description is given by way of non-limitative example only and is with reference to the accompanying drawings wherein.

DESCRIPTION OF PREFERRED EMBODIMENTS

Figure 1:
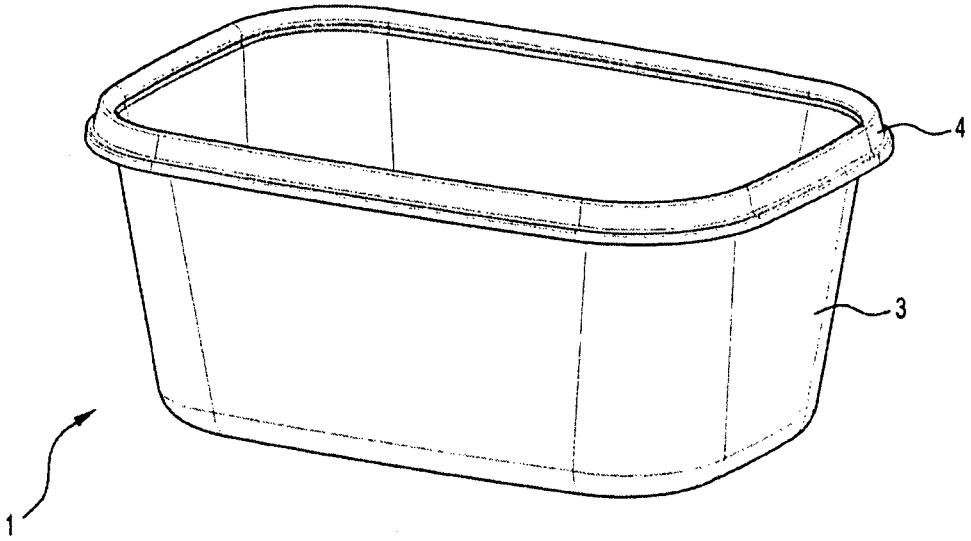
FIG. 1 is a top perspective view of a base for first embodiment of a container in accordance with the present invention, with the coloured strip or insert being represented by shading.
Figure 2:
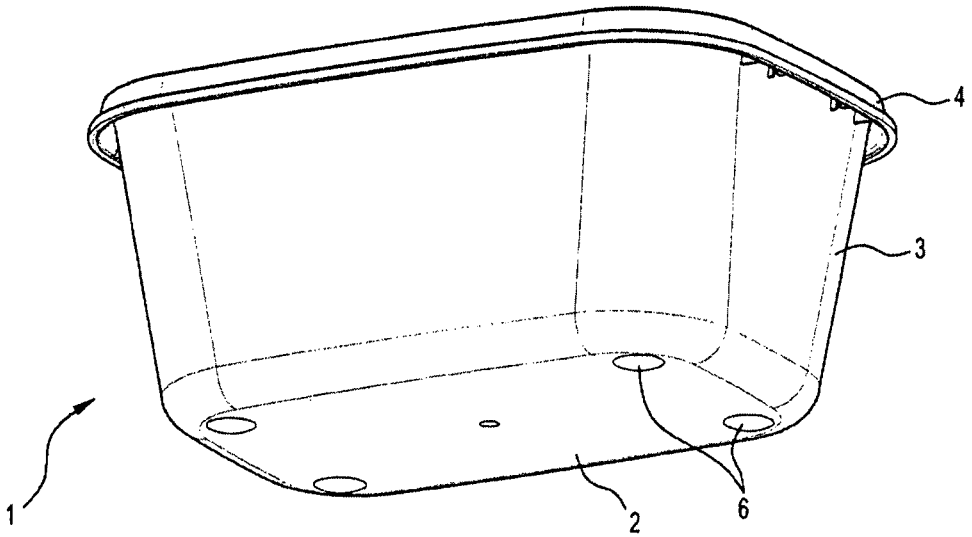
FIG. 2 is a bottom perspective view of the container base of FIG. 1.
Figure 3:
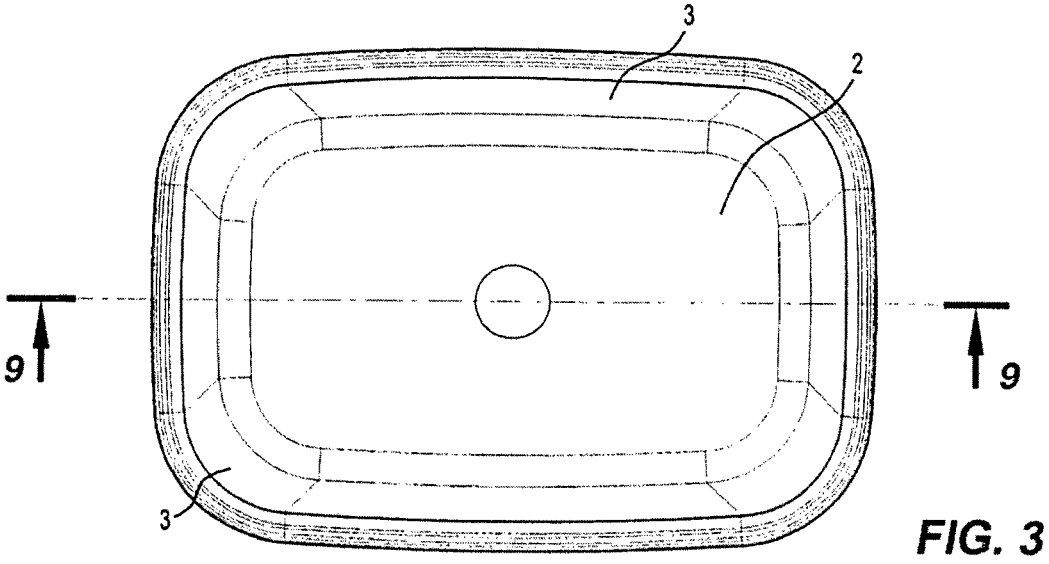
FIG. 3 is a top view of the container base of FIG. 1.
Figure 4:
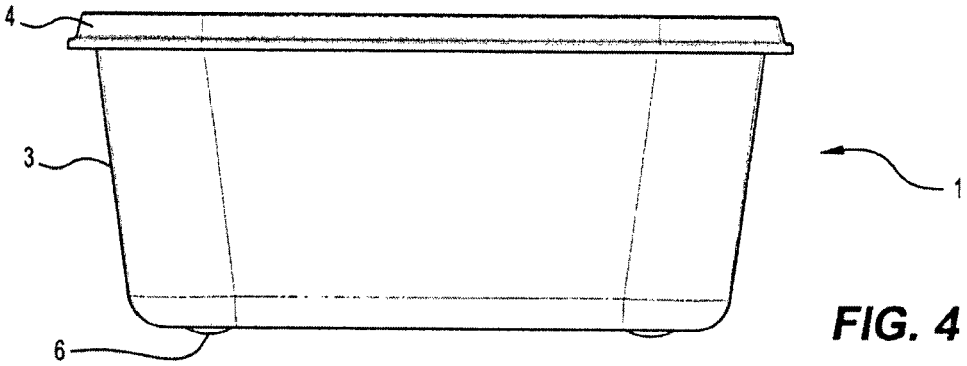
FIG. 4 is a side elevational view of the container base of FIG. 1.
Figure 5:
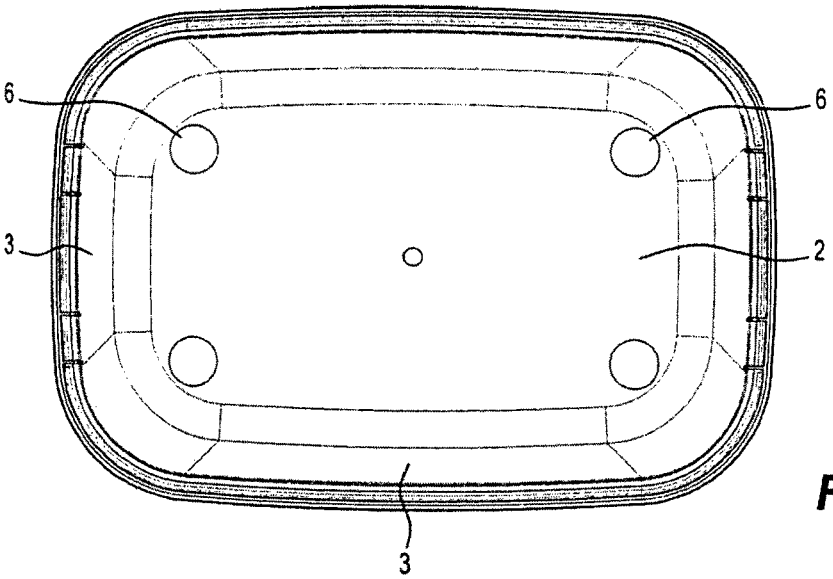
FIG. 5 is a bottom view of the container base of FIG. 1.
Figure 6:
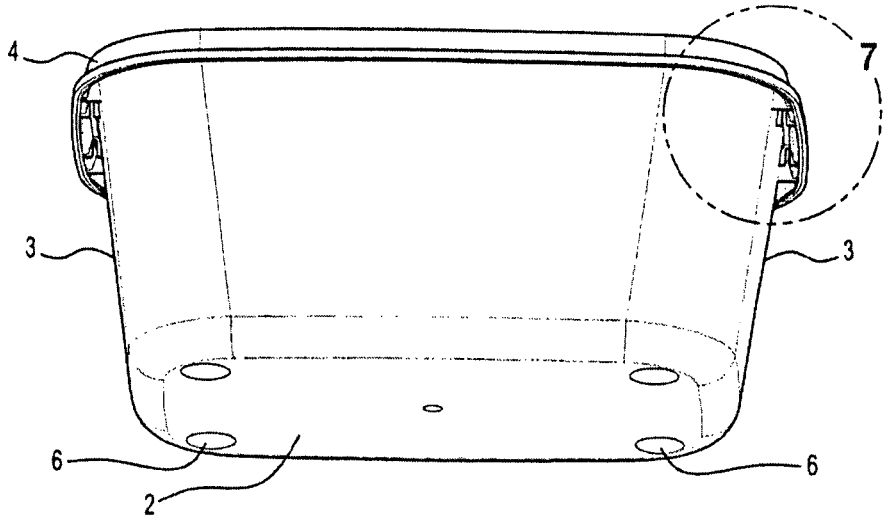
FIG. 6 is a side view from below of the container base of FIG. 1.
Figure 7:
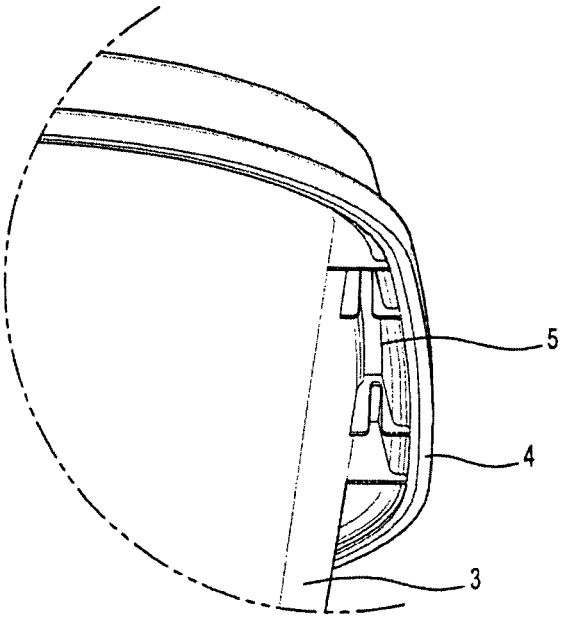
FIG. 7 is an enlarged side view, from below, of the base of FIG. 1 an arrangement for retaining a tag.

Turning to the drawings, and in particular to FIGS. 1 to 30 thereof, a container in accordance with a first aspect of the present invention includes, as principal components, a container base, generally designated 1, and a matching or compatible container lid, generally designated 100. It should be understood, however, that neither the material of construction of the overall container, nor the physical dimensions and shape thereof, are of the essence of the invention. The preferred material of construction is a plastics material but any mouldable material, as for example glass, could equally well be employed. As to overall shape, whilst the container base 1 and lid 100 illustrated are of a substantially oblong or rectangular shape when viewed in cross-section any shape could be employed, as for example, a square, elliptic or oval (round) shape, when viewed in cross-section. The height dimension of the container base 1 also may be varied from product to product, and does not constitute part of the invention.

With particular regard to FIGS. 1 to 6, the container base 1 includes a bottom 2 and an upwardly extending peripheral sidewall 3, with that sidewall 3 extending upwardly from the bottom 2 at an angle other than 90° thereto, such said wall 3 terminating in a shaped peripheral lip 4 depending outwardly and downwardly from the top edge of said peripheral sidewall 3.

In the preferred embodiment illustrated the container base 1 also includes a colour-coded strip 5 (see for example FIG. 21), of a colour different to that of the container 1, and preferably of a material of construction different from that of the container base 1. Preferably the strip 5 will be associated with and formed with the lip 4 of the container base 1 in a co-moulding operation. It should be understood, however, that the method of production of the overall container base 1, and the container lid 100 for that matter, is not of the essence of the invention.

The container base 1 further includes, at or in the vicinity of each corner of the bottom 2 thereof, a dimple or protrusion 6. These act as feet or supporting means for the container base 1, providing a space between the bottom 2 of a given container base 1 and that surface on which any such container base 1 is standing or located, or for that matter between the bottom 2 of one container base 1 and the bottom 2 of another container base 1 if stacked.

Figure 10:
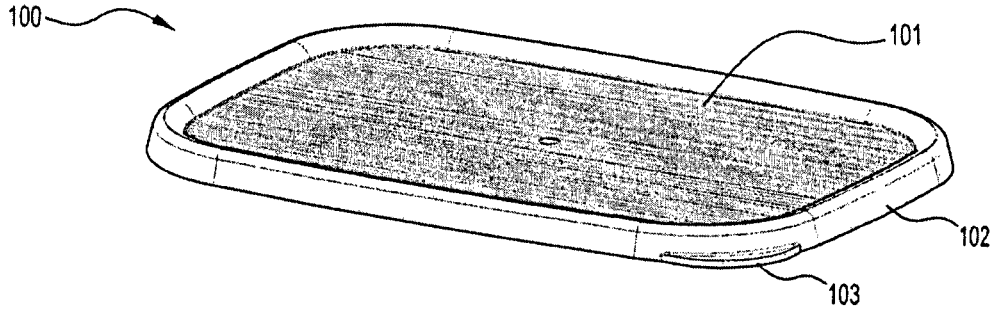
FIG. 10 is a top perspective view of a lid in accordance with the present invention, for use with the container base of FIG. 1, with the coloured strip or insert being represented by shading.
Figure 11:
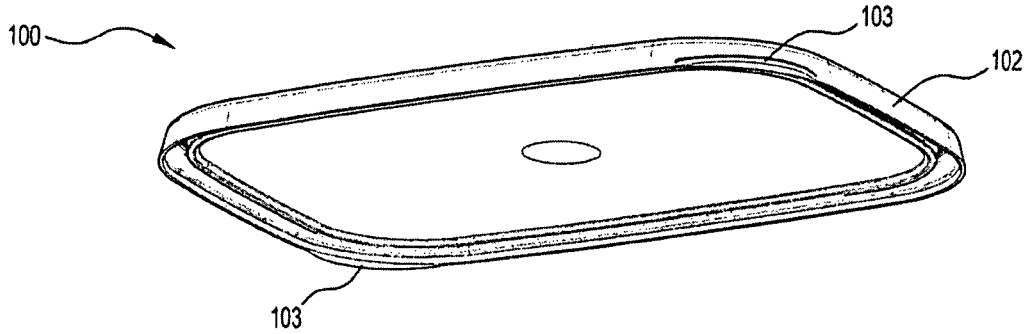
FIG. 11 is an underneath perspective view of the lid of FIG. 10.

The lid 100 as shown, for example, in FIG. 10, is of a complementary size and shape to the container base 1 and is adapted, in use, to overlay and seal that container base 1, giving rise to a sealed container. The lid 100 includes a main body portion 101 having a substantially channel-shaped peripheral lip 102 formed at the outermost edge thereof. When the lid 100 is located to overlap the container base 1, the peripheral lip 102 will extend over and be in contact with the lip 4 of the container base 1 (see for example FIGS. 29 and 30), whereby to provide a sealing effect. In the preferred embodiment illustrated the lid 100 includes opposed tabs 103 at at least two opposed corners thereof, to assist in removal of the lid 100 from the container base 1 when required. In an alternative embodiment, not shown, a tab 103 can be located at each corner of the lid 100.

Figure 14:
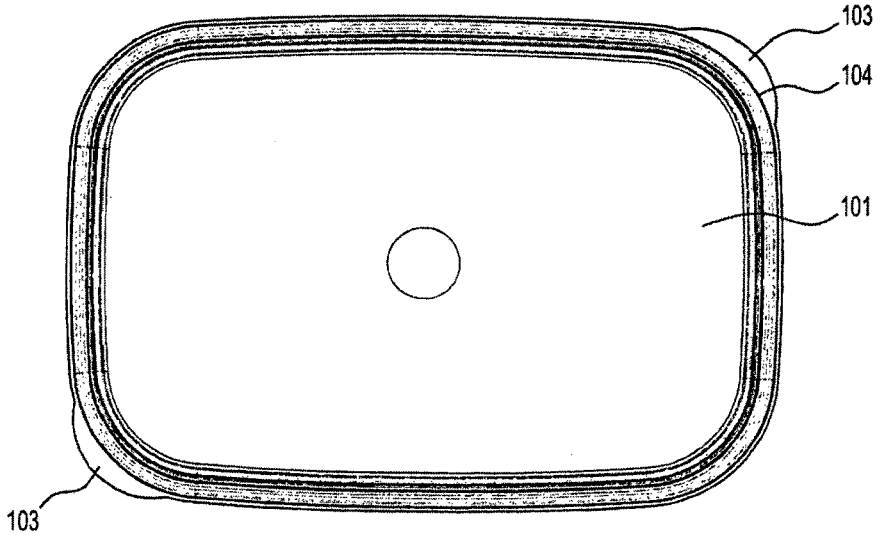
FIG. 14 is an underneath view of the lid of FIG. 10.
Figure 15:
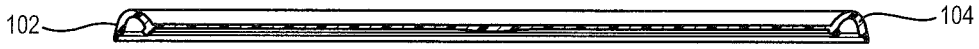
FIG. 15 is a sectional view of the lid of FIG. 10.

The lid 100 further includes, to be fixedly located within the peripheral lip 102, a shaped peripheral strip 104 (shown as shaded in FIG. 14, for example). Preferably the strip 104 will be formed with the lid 100 in a co-moulding operation. Preferably the lid 100 will be formed from a clear plastics material or the like, whilst the strip 104 will be of a coloured plastics material (not necessarily the same material as used to form the lid 100). The colour of the strip 104 will be the same as that of the strip 5 of the container base 1.

Figure 8:
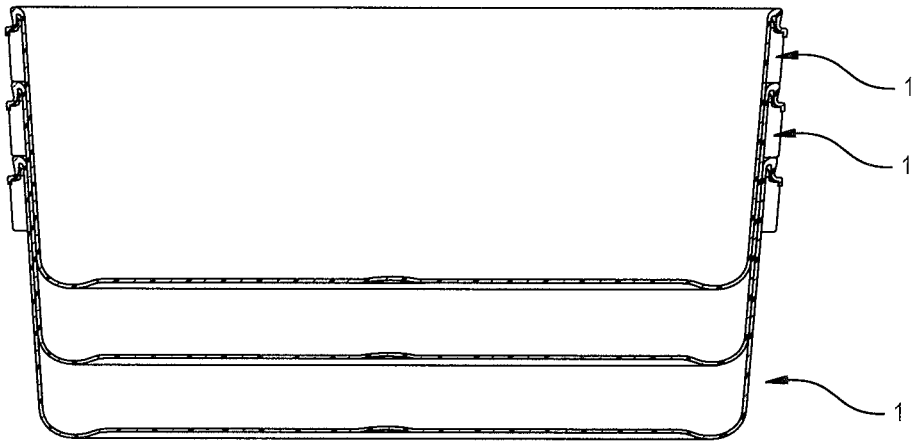
FIG. 8 is a sectional view showing a plurality (in this instance three) of container bases in accord with the prior art when stacked together.
Figure 9:
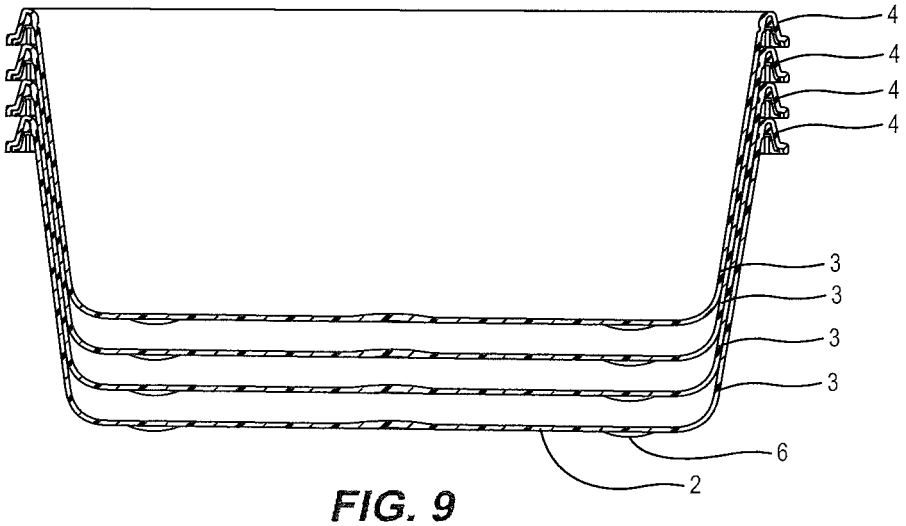
FIG. 9 is a view, similar to FIG. 8, but showing four container bases in accord with the present invention when stacked together.

With regard to FIGS. 8 and 9, such show how a plurality of container bases 1 in accordance with this embodiment of the present invention can be stacked, in an extremely effective and space-saving manner, when compared with the prior art. The fact that the peripheral sidewall 3 extends upwardly from the bottom 2 at an angle other than at right angle, and the shape and configuration of the peripheral lip 4 itself, means that such container bases 1 can be stacked in an optimum fashion with a second container base 1 able to be disposed within a first, similarly sized and shaped container base 1 with the respective lips 4 of adjacent container bases 1 being in contact with one another. For a given area of storage space, or real estate as referred to earlier in this specification, a larger number of container bases 1 can be stored when compared with the prior art, an important marketing advantage.

Figure 12:
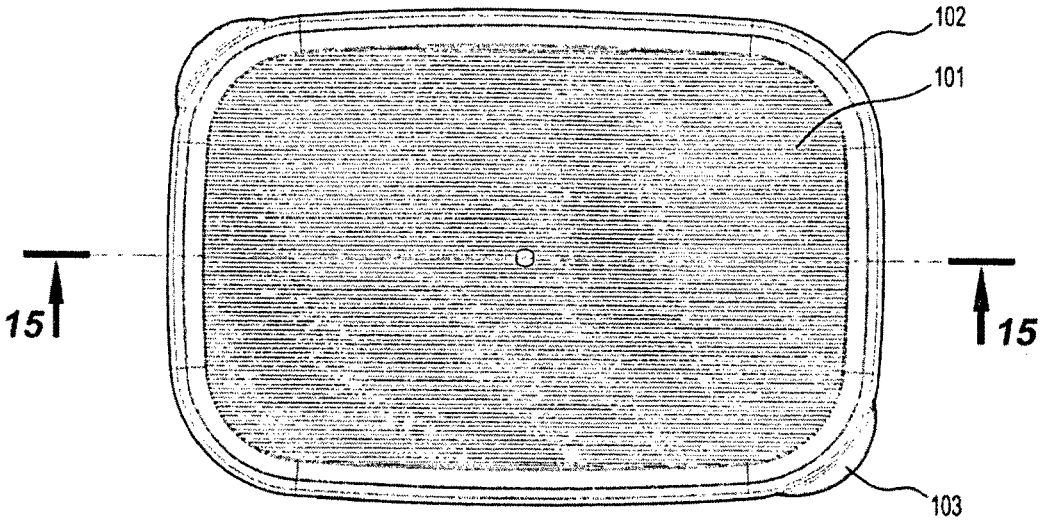
FIG. 12 is a top view of the lid of FIG. 10.
Figure 13:
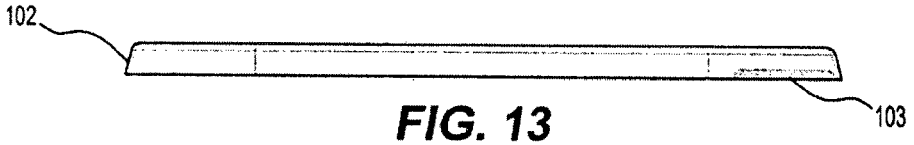
FIG. 13 is a side view of the lid of FIG. 10.

As shown, for example, in FIG. 12, the lid 100 in an especially preferred embodiment includes, formed in the upper surface thereof, a pattern made from a plurality of spaced-apart parallel lines, which as shown extend across substantially the entire upper surface of the main body portion 101 of the lid 100. In alternative embodiments, not shown in the drawings, a lid in accordance with the present invention may have, formed in the upper surface thereof, other distinguishing patterns, as for example an array of small circles, crescents or indeed any other shapes, extending across at least part of the upper surface thereof.

Figure 16:
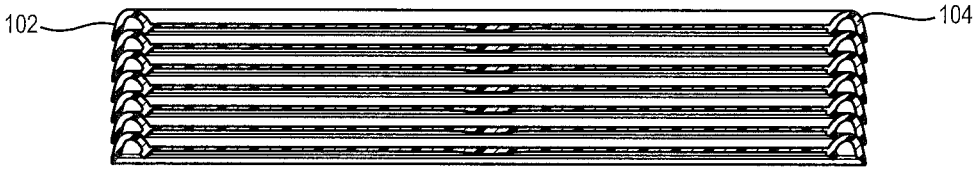
FIG. 16 is a sectional view showing a plurality, in this instance seven of the lids of FIG. 10 when stacked together.
Figure 17:
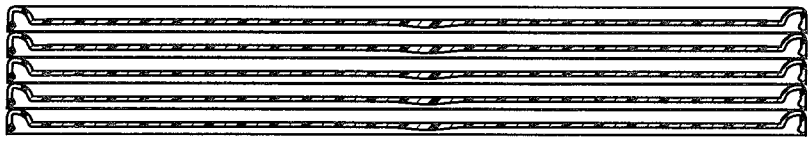
FIG. 17 is a view, similar to FIG. 16 but showing the poor stackability of a plurality of lids in accordance with the prior art.

FIG. 16 shows the improved stackability of lids 100 in accordance with the invention, due primarily to the shape and configuration of the peripheral lip 102, and associated colour-coded strip 104. This should be compared with the prior art, as shown in FIG. 17.

Figure 18:
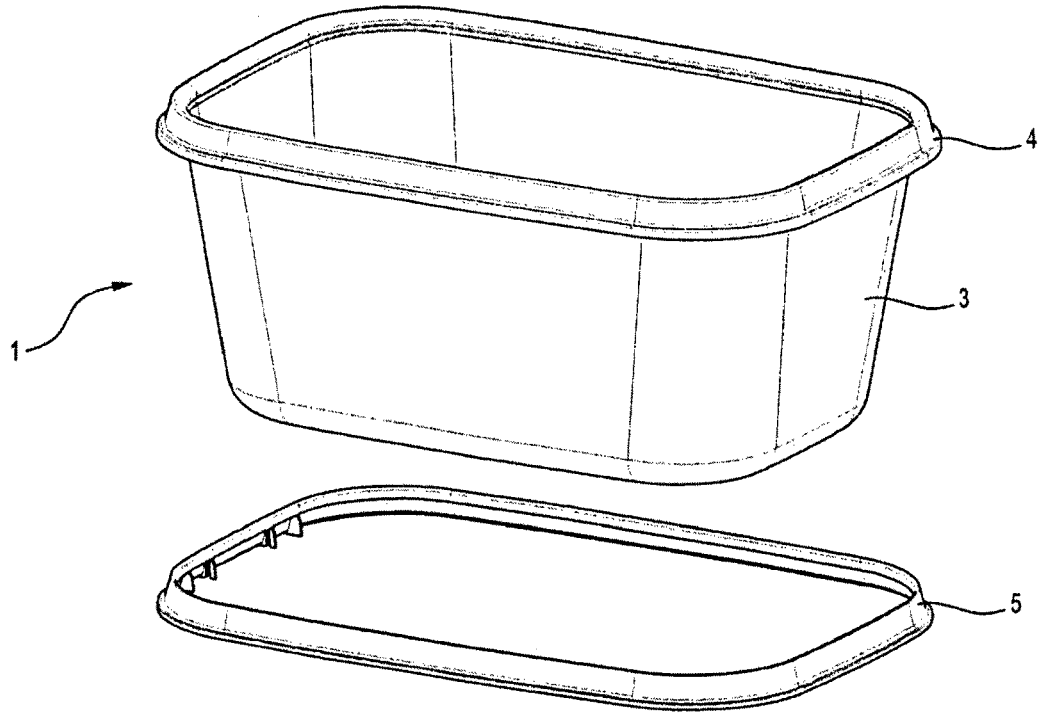
FIG. 18 is a top perspective view showing a container base and coloured strip, in accordance with the present invention, when separated.
Figure 19:
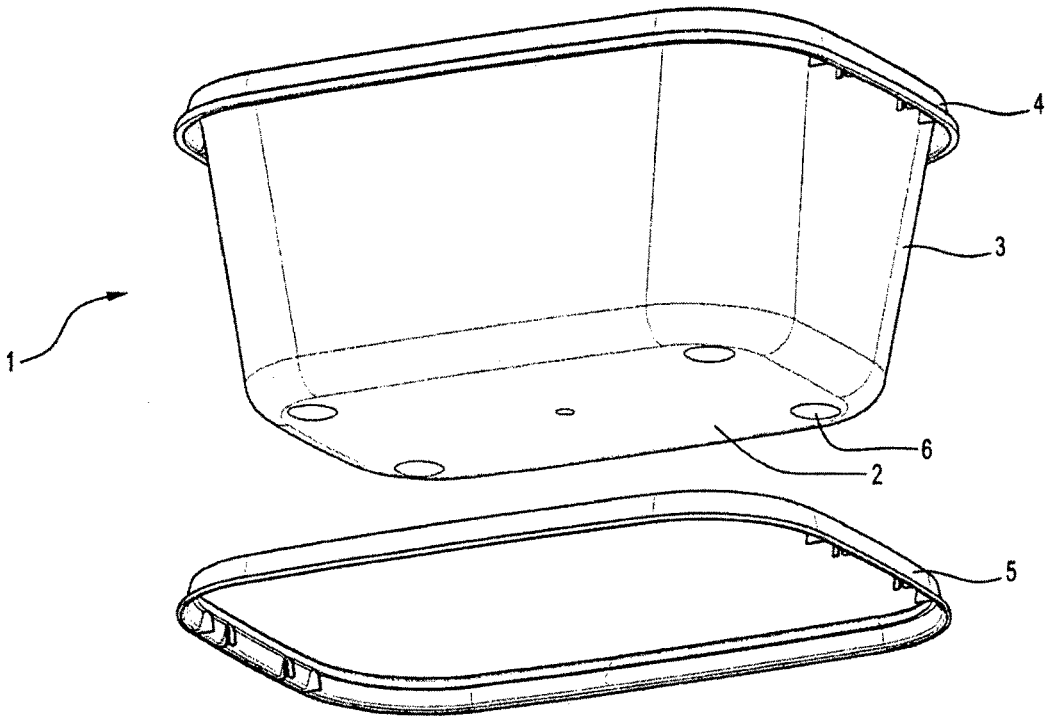
FIG. 19 is a bottom perspective view of the container base and strip of FIG. 18.
Figure 20:
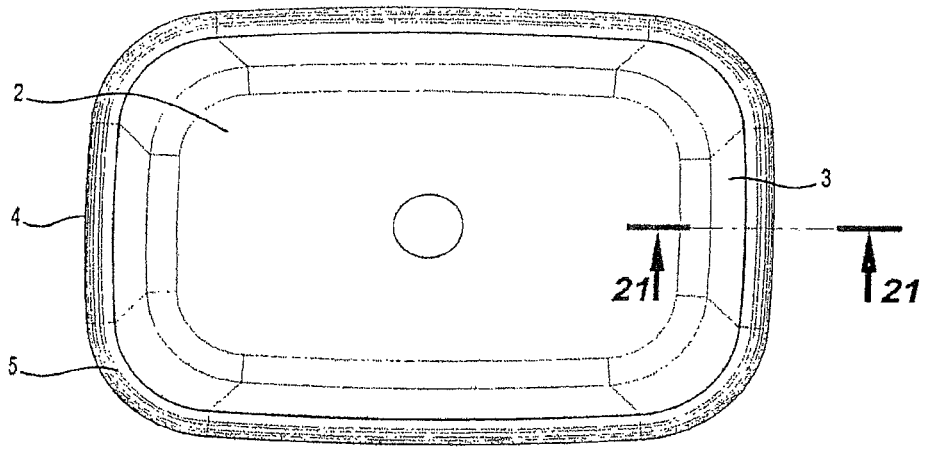
FIG. 20 is a plan view of the container base.
Figure 21:
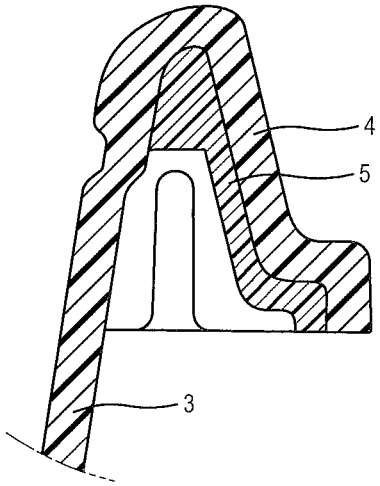
FIG. 21 is a sectional view taken along the line 21-21 of FIG. 20.

FIGS. 18 and 19, to allow for a better understanding of the invention, show a container base 1 and its associated coloured strip 5 as separate elements. It should be realised, however, that since the overall container base 1 and associated coloured strip 5 are formed in a co-moulding procedure, in practice such will not be separate or distanced/separated one from the other as shown.

Figure 22:
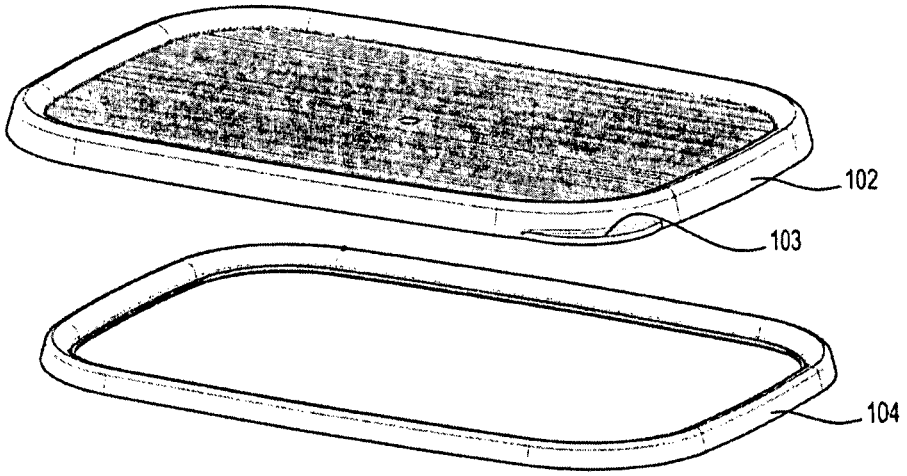
FIG. 22 is an exploded top perspective view of a lid in accordance with the present invention, showing the lid itself and the colour-coded band shown separated.
Figure 23:
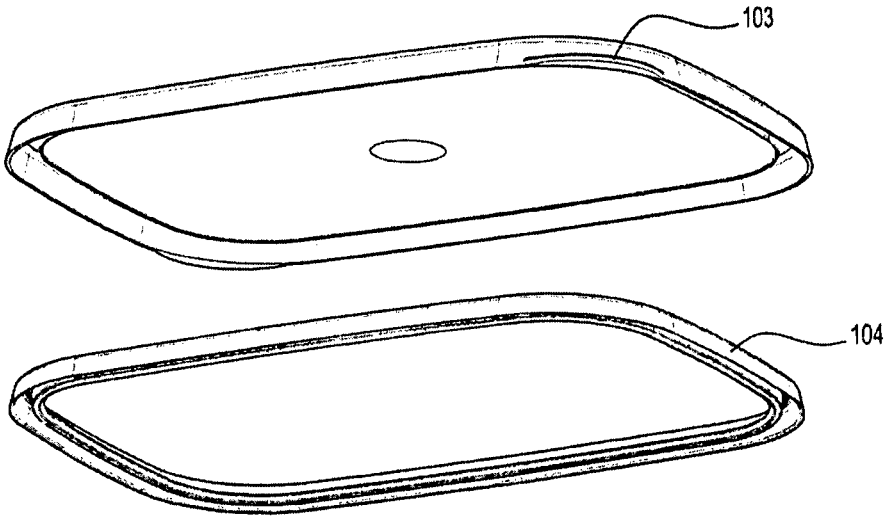
FIG. 23 is a bottom perspective view similar to FIG. 22.
Figure 24:
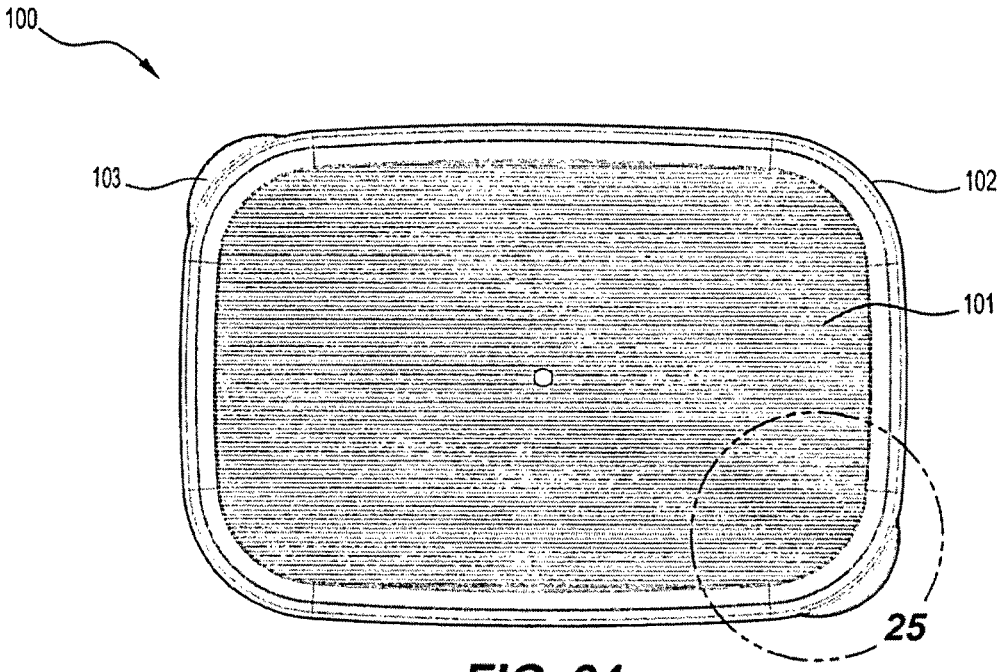
FIG. 24 is a top view of a lid in accordance with the invention.
Figure 25:
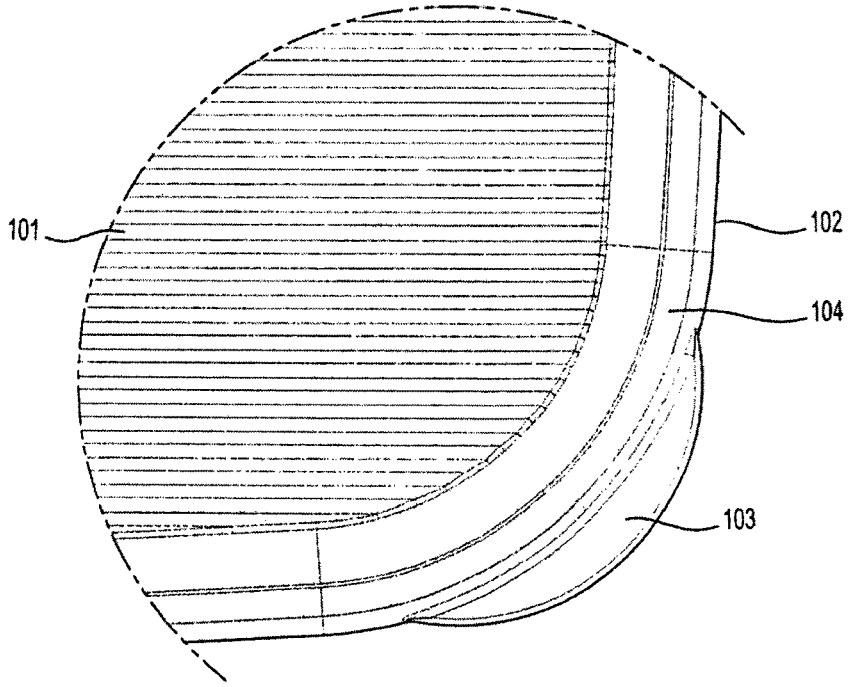
FIG. 25 is an enlarged view of a corner of the lid of FIG. 24.
Figure 26:
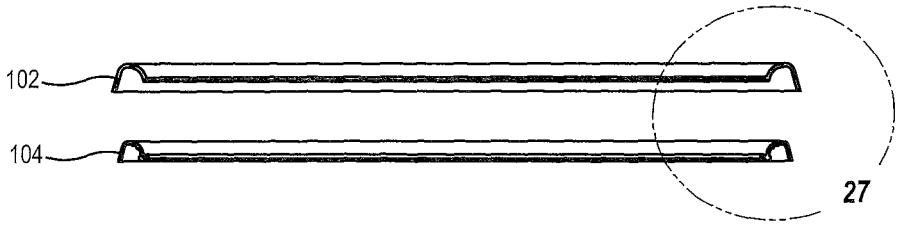
FIG. 26 is a sectional view of a portion of the periphery of the lid and colour-coded band of FIG. 22.
Figure 27:
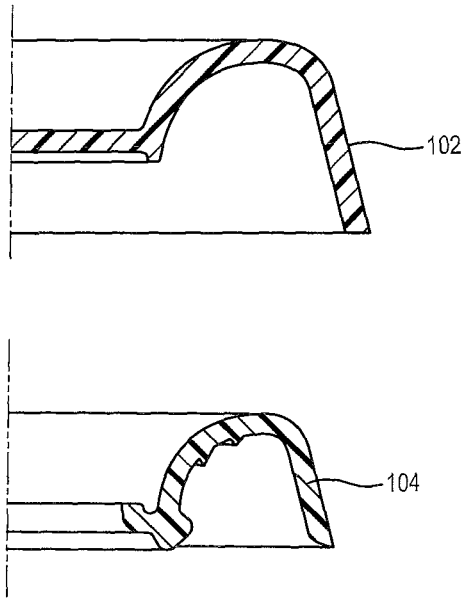
FIG. 27 is an enlarged view showing the cross-sectional shape of each of the lid and coloured band.
Figure 28:
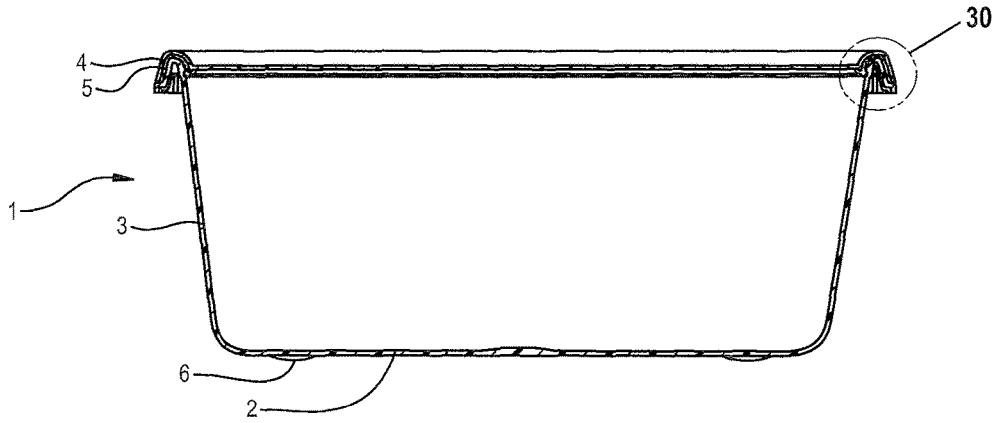
FIG. 28 is a view showing the assembly of the container base and lid in accordance with the invention.

FIGS. 22 and 23 are similar to FIGS. 18 and 19, showing the lid 100 and an associated co-moulded colour strip or band 104 as separate elements.

Figure 29:
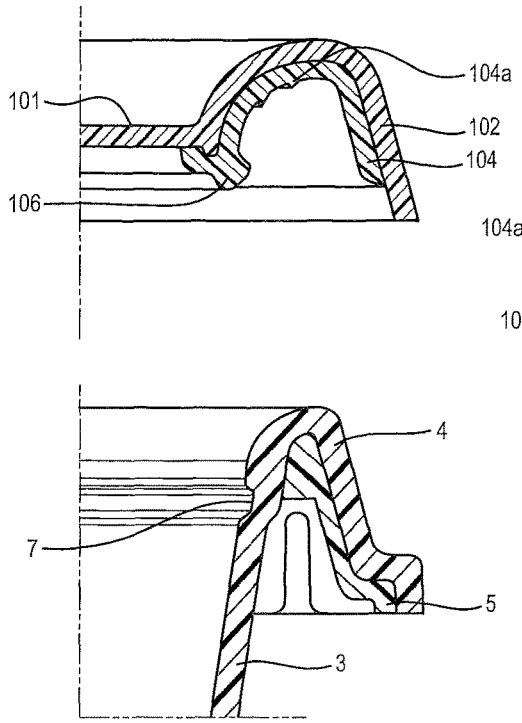
FIG. 29 show enlarged views of both the container of FIG. 1 and the lid of FIG. 10.
Figure 30:
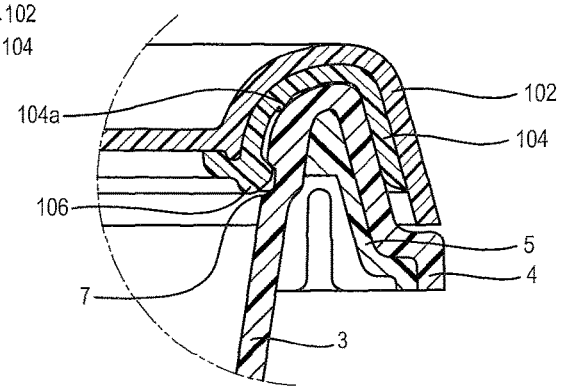
FIG. 30 is a sectional view of the container and lid when interconnected.

The side wall 3 of the container base of the preferred embodiment shown in FIGS. 29 and 30 includes a shaped peripheral cavity 7 in the vicinity of, but spaced from, the uppermost extension or edge of that sidewall 3, which provides a seating for a protrusion 106 of the coloured strip 104 of the lid 100, to afford an enhanced sealing effect (as shown in FIG. 30 for example).

Figure 30A:
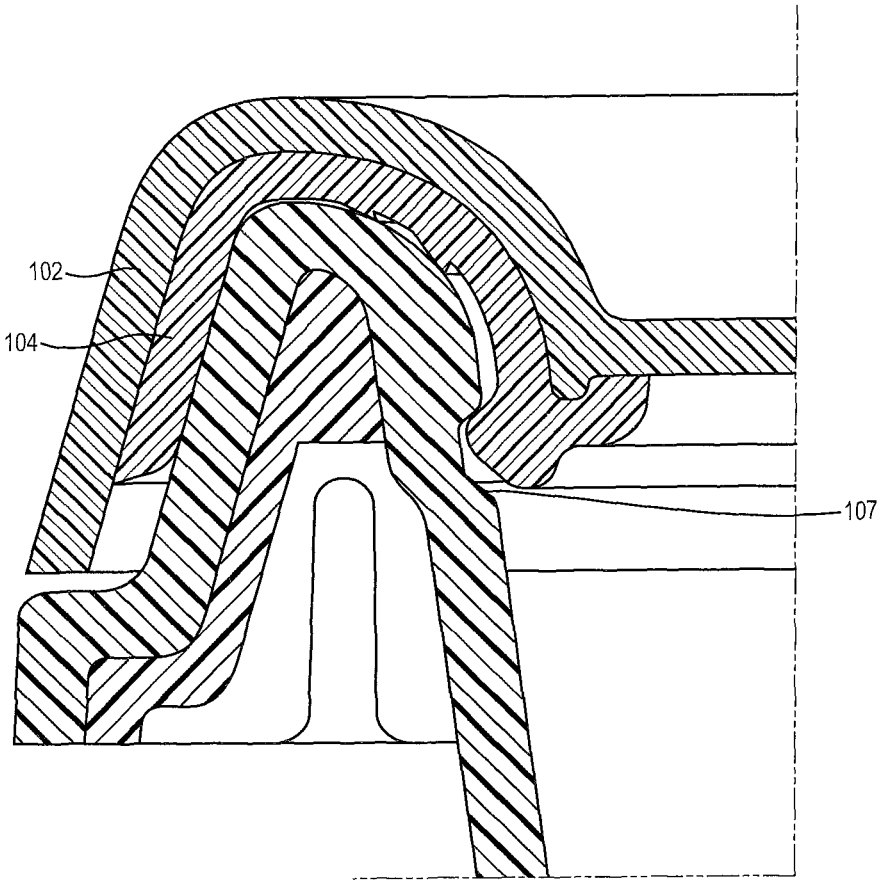
FIG. 30*a* is a view, similar to FIG. 30, of an alternative arrangement in accordance with the present invention.
Figure 32:
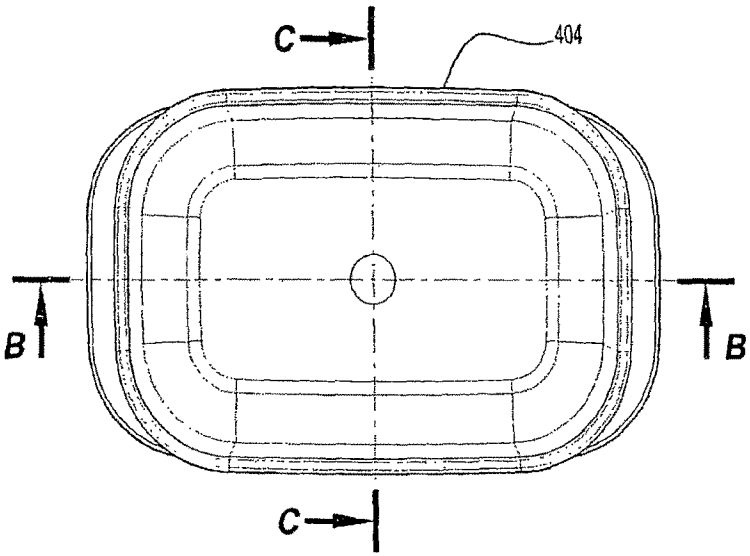
FIG. 32 is a top view of the base of FIG. 31.
Figure 33:
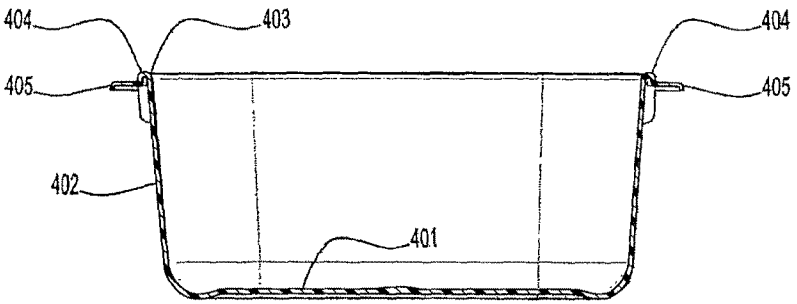
FIG. 33 is a sectional view taken along the line B-B in FIG. 32.
Figure 34:
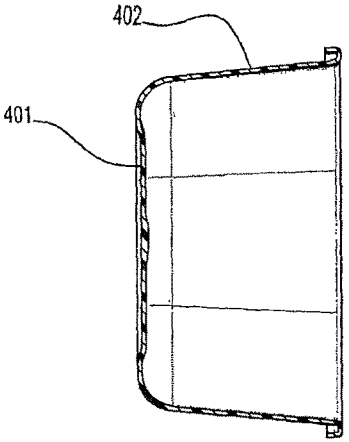
FIG. 34 is a sectional view taken along the line C-C in FIG. 32.
Figure 31:
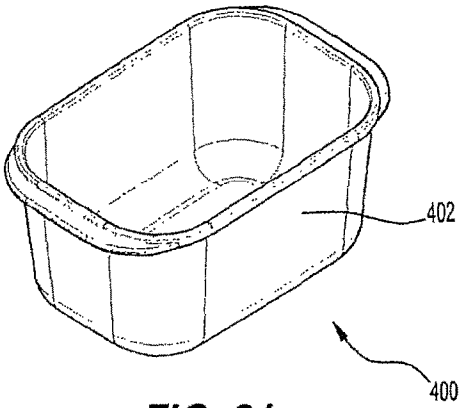
FIG. 31 is a top perspective view of a base for a container in accordance with a further embodiment of the invention.
Figure 36:
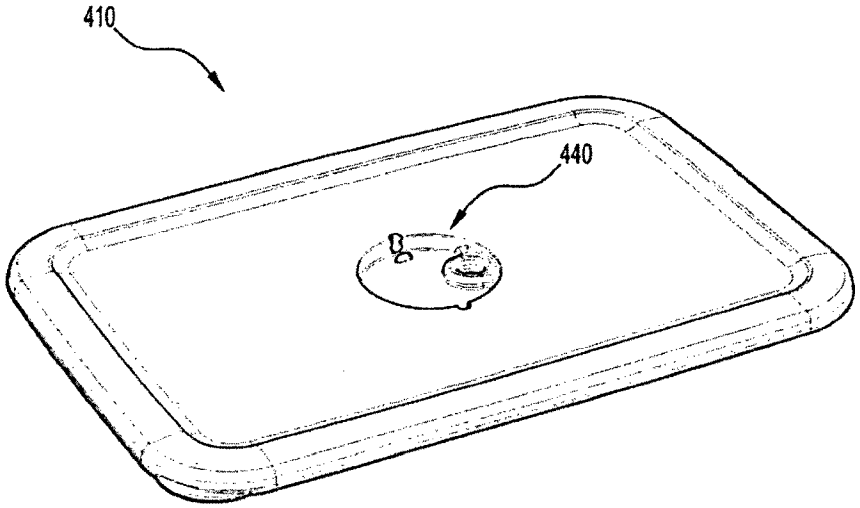
FIG. 36 is a top perspective view of the lid of FIG. 35.
Figure 35:
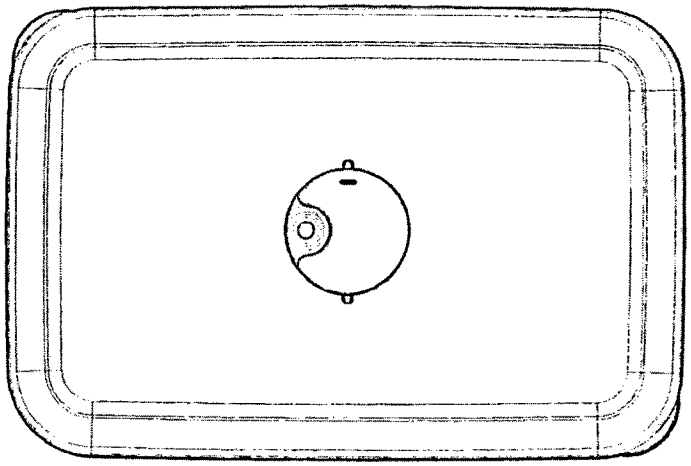
FIG. 35 is a top view of a lid for a container in accordance with the embodiment of the invention of FIG. 31.
Figure 37:
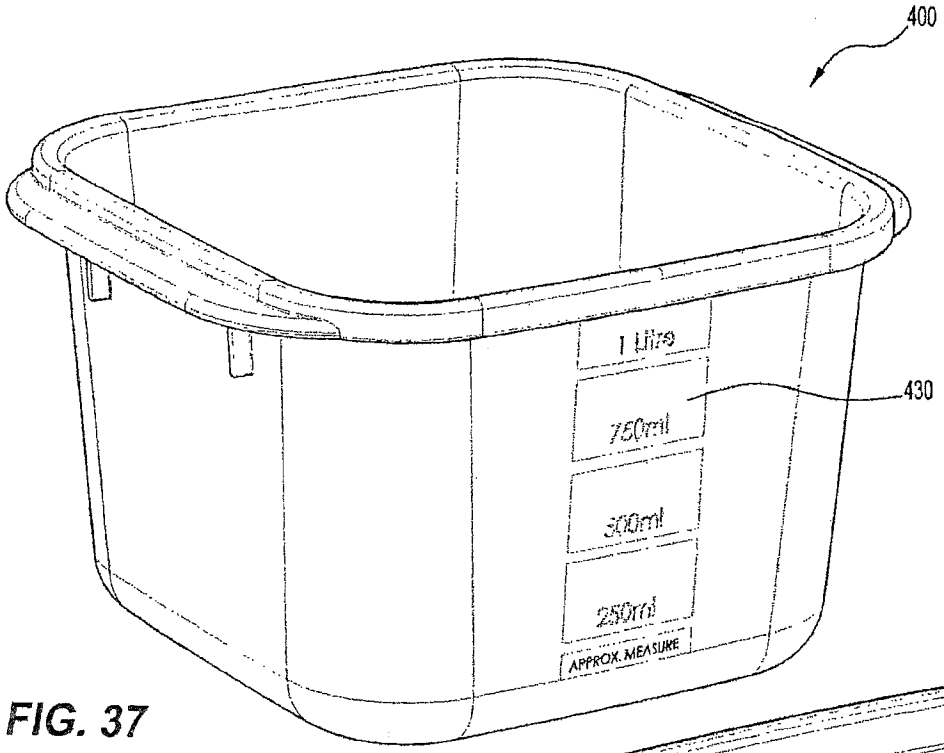
FIG. 37 is a perspective view of a container base in accordance with the embodiment of FIG. 31.

In that preferred embodiment the coloured strip 104 further includes at least one, and preferably a plurality of, protrusions 104*a*, in use being in engagement with the surface of the peripheral lip 102 of the container base 1, to provide for a further sealing effect between coloured strip 104 and peripheral lip 103. It should be understood, however, that the existence of such protrusion or protrusions 104*a* is merely a preferred feature of the invention In the alternative embodiment shown in, for example, FIG. 30*a* the coloured band 104 includes, at or in the vicinity of the upper edge thereof, a recess 107. That recess 107, formed integrally of the coloured band 104, assists in manufacture of the overall sealing means, facilitating removal thereof from a die subsequent to manufacture.

The combination of container base 1 and lid 100 in accordance with this embodiment of the present invention exhibits a number of advantages/improvements over the prior art.

Firstly, since both the container base 1 and lid 100 include a band or strip of the same colour, then the task of identifying matching bases and lids is simplified.

Secondly, and by reason of the shape and configuration of the overall container, and in particular the container bases, stackability thereof is improved. For display purposes, a greater number of container bases in accordance with this embodiment of the invention can be stored or displayed in a given area of real estate, when compared with the prior art.

With reference now to FIGS. 31 to 40 of the drawings, there is shown therein another preferred embodiment of a container in accordance with the invention, which includes three principal components, namely a container base 400, a lid 410 and a separate sealing means 420.

In this embodiment the container base 400, constructed of any suitable material, as for example a plastics material or glass, in like manner to that of FIGS. 1 to 30 includes a bottom 401 and an upwardly extending peripheral sidewall 402. Whilst, in the preferred embodiment illustrated, the base 400, lid 410 and sealing means 420 are all substantially parallelepipedal in shape (when viewed in plan), it should be understood that the actual shape thereof (when viewed in plan) is not of the essence of the invention. Indeed the overall container may be circular, oval, square or any other shape (when viewed in plan). The sidewall 402 extends upwardly from the bottom 401, preferably substantially at a right angle thereto or, in an alternative arrangement, at an angle other than 90° thereto, to an upper rim 403. Extending outwardly from the rim 403, around at least part of the periphery thereof, is a flange 404. In an especially preferred embodiment such flange 404, preferably at opposed ends of the container, includes an enlarged section 405 which, in use, acts as a seating for the lid 410 of the container. The flange 404 preferably extends around the entire periphery of the base 400 of the overall container.

In an especially preferred embodiment, the flange 404 extends around the entire periphery of the base 400 of said container and terminates in a downwardly depending lip 405. At opposed ends of said base 400 an enlarged flange is formed at the free, lower end of the lip 405.

In the preferred embodiment illustrated the base 400 of the overall container may include means for receiving and releasably retaining at least one removable indicator tag (not shown), which tag can be attached, in use, to a peripheral rim, a pedestal, or under a peripheral rim to the sidewall 402. Tags of this general type (not shown) are described in more detail in, for example, the present applicant's U.S. Pat. No. 5,865,339. However such tag, and the means for attachment thereof, do not constitute part of the present invention.

The lid 410 is of a substantially complementary shape to that of the base 400 and is adapted, in use, to overlay said base 400. The lid 410 includes a main body portion having a peripheral lip extending substantially at a right angle thereto. When the lid 410 is in position relative to the base 400, the lip 400 thereof will extend over and be in contact with the flange 405 of the base 400 (to provide an enhanced sealing effect).

The lid 410 may further include means, generally designated 440, which allows for venting of the container as and when necessary. It should be understood, however, that such does not constitute part of the invention. Indeed any suitable means for venting may be employed.

The sealing means 420 preferably is constructed from a flexible elastomeric material, more preferably silicone or silicone rubber. It should be understood, however, that the actual material of construction is not of the essence of the invention. Indeed any suitable flexible, resilient, food-grade plastics or the like material may be employed in the construction thereof.

In accordance with the invention the venting means 440 of the lid 410, as well as the sealing means 420, will be of a colour, more preferably the same colour, and more importantly of a colour which is different from that of the material making up the remainder of the lid 410, and of the container base 400. Such can be achieved in any known manner and using any known means, as for example by including a colourant in the plastics or other material during formation of the venting means 440 and sealing means 420. By being of the same colour, such facilitates or assists the user in matching a given lid (with venting means) with a compatible—meaning of the same size and shape—sealing means, in turn facilitating use of any given container. Preferably different colours will be employed for different sized lids and associated sealing means.

Again in accordance with the invention, and this to allow for matching up of a given base 400 with both its compatible lid 410 and sealing means 420, the base 400 includes, preferably in the peripheral side wall 402 thereof, at least one area 430 which is of a different colour to the remainder of that base 400, indeed of the same colour as the compatible lid 410 (with coloured venting means 440) and the compatible sealing means 420. With such an arrangement it becomes a simple task for the prospective user to select, from for example a drawer or the like which contains a number of differently sized and shaped bases 400, lids 410 and sealing means 420, firstly the particular sized and shaped base 400 to satisfy user requirements, and then the compatible lid 410 (with venting means) and separate sealing means 420. This avoids the sometimes "hit and miss", and extremely frustrating, procedure necessary with the prior art containers of this general type.

In one preferred embodiment of the invention the differently coloured area or section or area 430 of the container base 400 may be an integral part of the peripheral wall 402 thereof. In an alternative embodiment such may be in the form of a tag or the like adapted to be attached, releasably or permanently, to the peripheral wall 402 of the base 400.

The location or size of the coloured area or section 430 on the container base 400 does not form part of the invention, and such area 430 can be disposed at any suitable location on that base 400. Preferably, however, it will be disposed on the peripheral wall 402 at a physical location at or in the vicinity of the bottom wall 401.

Figure 38:
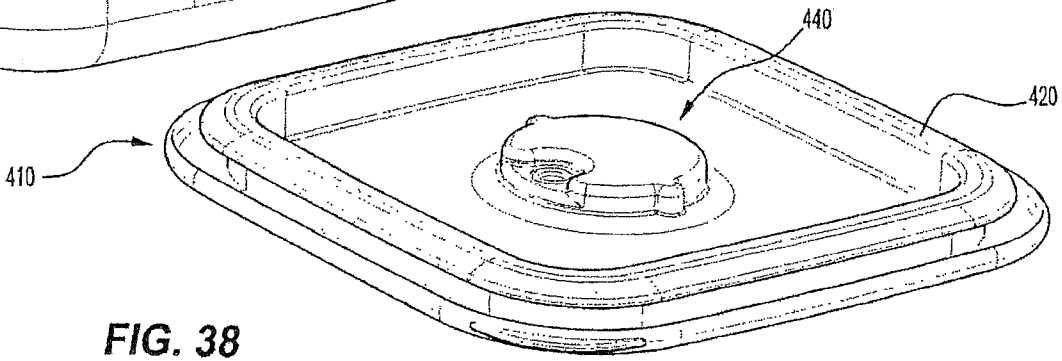
FIG. 38 is a perspective view of a lid and separate sealing means for the container base of FIG. 37.
Figure 39:
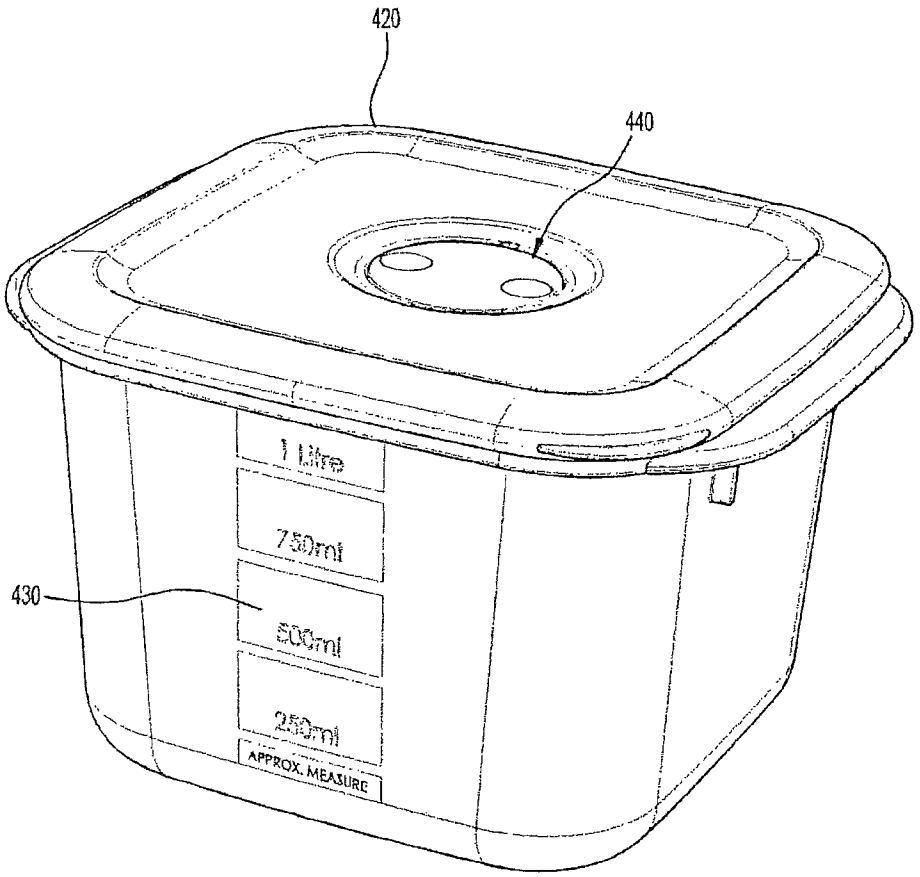
FIG. 39 is a perspective view of a container—a combination of base, lid and separate sealing means in accordance with the embodiment of FIG. 31.
Figure 40:
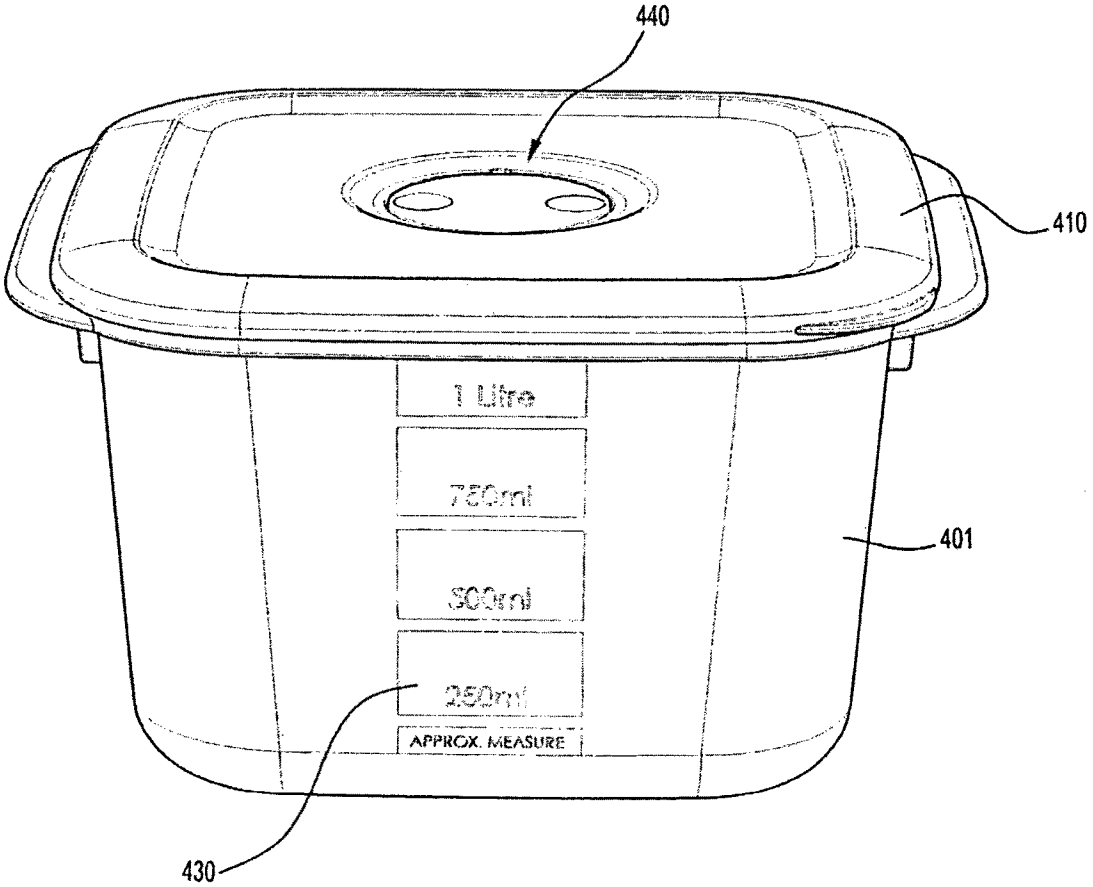
FIG. 40 is a further perspective view, from the side, of a container in accordance with the invention.

In the especially preferred embodiment shown in FIGS. 38 to 40 of the drawings, the coloured area 430 of the peripheral wall 402 of the container base 400 may be appropriately disposed on the base 400, and have graduations or the like indicia appearing thereon, such as to provide the user with an indication as to the volume of content housed within the base 400 at any given time.

The lid 410 in an especially preferred (not shown) may include, formed in the upper surface thereof, a pattern made from a plurality of spaced-apart parallel lines, which can extend across substantially the entire upper surface of the main body portion of the lid 410. In alternative embodiments, again not shown in the drawings, a lid in accordance with the present invention may have, formed in the upper surface thereof, other distinguishing patterns as for example an array of small circles, crescents or indeed any other shapes, extending across at least part of the upper surface thereof.

With the embodiment of FIGS. 1 to 30*a*, both the Container bases and matching lids lend themselves to being stackable, to a greater extent than known containers of this general type. This has advantages, whether in the commercial (sales) or domestic environment, in that more container basis, and more lids, can be stored in a given area.

By having the lid which fits a given container base, in the embodiment of FIGS. 1 to 30*a*, having a colour coded strip of the same colour as that on the base, this allows the user to readily select, from a plurality of possibilities, both the desired sized and shaped container and, more importantly, the lid therefor.

Finally, it is to be understood that the a foregoing description refers merely to preferred embodiments of the invention, and that variations and modifications will be possible thereto without departing from the spirit and scope of the invention, the ambit of which is to be determined from the following claims.

The invention claimed is:

1. A plurality of storage containers, each storage container including:

a base including: a bottom wall and at least one sidewall, said at least one sidewall extending substantially upwardly from said bottom wall an angle other than 90° and terminating in a peripheral rim having an outwardly extending lip; a lid formed from a clear plastics material and adapted to be compatible with and sealingly close the base and to extend thereacross in a covering relationship, wherein the plurality of containers includes differently sized and shaped bases and their compatible lids, each base and its compatible lid including a colored identification means in the form of an area on each of the base and its compatible lid that is of the same color for matching the base with its compatible lid, the colored identification means on any base and its compatible lid being a color that is different to that of the remainder of the base and its compatible lid;

wherein differently sized and shaped bases and their compatible lids have colored identification means of different colors;

wherein container bases of the same size and shape can stack one in another due to the shape and configuration of the peripheral lip and the angled sidewall;

the colored identification means on each of the lids being a sealing means provided on a peripheral underside of each lid to cooperate with the sidewall of a compatible base; and wherein the colored identification means on the base:

is a peripheral band or strip on the peripheral lip on a top edge of the base sidewall; and/or comprises an area formed integrally with the sidewall.

2. The plurality of storage containers as claimed in claim 1, wherein said are each constructed principally of a material which is transparent.

3. The plurality of storage containers as claimed in claim 1, wherein said sealing means extends around the periphery of said lid.

4. The plurality of storage containers as claimed in claim 1, wherein said colored identification means is joined/associated with said bases and said lids in a co-molding operation.

5. The plurality of storage containers as claimed in claim 4, wherein said colored identification means is of a material which is different to the material of construction of said base and said lid.

6. The plurality of storage containers as claimed in claim 5, wherein said base and said lid are each formed from a moldable plastics material.

7. The plurality of storage containers as claimed in claim 1, wherein the lid of at least one storage container includes a venting means, said venting means being constructed from a material having the same color as the colored identification means of the compatible base.

8. The plurality of storage containers as claimed in claim 7, wherein said bases, said lids and said venting means are constructed principally of plastics material.

9. The plurality of storage containers as claimed in claim 1, wherein said bases are constructed from glass.

10. The plurality of storage containers as claimed in claim 1, wherein the colored identification means on the sidewall is located at or in the vicinity of the juncture of said at least one sidewall and said bottom wall of said base and extends substantially normally to said bottom wall, and includes markings or indicia thereon providing an indication as to the volume occupied by the content of said container.

11. The plurality of storage containers as claimed in claim 1, wherein said sealing means is constructed from a non-rigid elastomeric material, said non-rigid elastomeric material being silicone or silicone rubber.

12. The plurality of storage containers as claimed in claim 1, wherein the bases are stackable.

* * * * *